US006840610B2

(12) United States Patent
Taniguchi et al.

(10) Patent No.: US 6,840,610 B2
(45) Date of Patent: Jan. 11, 2005

(54) LIQUID CONTAINER, INK JET CARTRIDGE AND INK JET PRINTING APPARATUS

(75) Inventors: Suguru Taniguchi, Tokyo (JP); Akira Tsujimoto, Kanagawa (JP); Toshihiko Ujita, Kanagawa (JP); Kiyomitsu Kudo, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 30 days.

(21) Appl. No.: 10/370,528

(22) Filed: Feb. 24, 2003

(65) Prior Publication Data

US 2003/0160848 A1 Aug. 28, 2003

(30) Foreign Application Priority Data

Feb. 22, 2002 (JP) ..... 2002-046709

(51) Int. Cl.[7] ..... B41J 2/175
(52) U.S. Cl. ..... 347/86; 347/87
(58) Field of Search ..... 347/86, 85, 87; 114/2, 18

(56) References Cited

U.S. PATENT DOCUMENTS

| | | | | |
|---|---|---|---|---|
| 4,771,295 A | * | 9/1988 | Baker et al. | 347/87 |
| 5,280,299 A | | 1/1994 | Saikawa et al. | 346/1.1 |
| 5,621,446 A | | 4/1997 | Tanaka et al. | 347/85 |
| 6,015,210 A | | 1/2000 | Kanematsu et al. | 347/87 |
| 6,505,915 B2 | | 1/2003 | Asakawa et al. | 347/65 |
| 6,540,321 B1 | | 4/2003 | Hirano et al. | 347/22 |
| 6,612,683 B2 | * | 9/2003 | Takahashi et al. | 347/30 |
| 2001/0040610 A1 | | 11/2001 | Kurata et al. | 347/85 |

FOREIGN PATENT DOCUMENTS

| | | |
|---|---|---|
| DE | 101 05 352 | 8/2002 |
| EP | 1057644 | 12/2000 |
| JP | 60-18349 | 1/1985 |
| JP | 3-175051 | 7/1991 |
| JP | 9-300646 | 11/1997 |
| JP | 2000-225714 | 8/2000 |
| JP | 2000-334978 | 12/2000 |
| JP | 2001-96761 | 4/2001 |
| JP | 2001-301190 | 10/2001 |

* cited by examiner

*Primary Examiner*—Anh T.N. Vo
(74) *Attorney, Agent, or Firm*—Fitzpatrick, Cella, Harper & Scinto

(57) ABSTRACT

A sub-tank unit of an ink jet cartridge can contain ink for image printing therein. The sub-tank unit includes a container main body having a ink storage for storing the ink, a ventilation path enabling the liquid storage and the outside of the container main body to communicate with each other, a gas liquid separation member disposed to communicate with the ventilation path, and a capillary member disposed between the ink storage and the gas liquid separation member.

12 Claims, 13 Drawing Sheets

PRIOR ART

PRIOR ART

LIQUID CONTAINER, INK JET CARTRIDGE AND INK JET PRINTING APPARATUS

This application claims priority from Japanese Patent Application No. 2002-046709 filed Feb. 22, 2002, which is incorporated hereinto by reference.

BACKGROUND OF THE INVENTION

1. Field of the Invention

The present invention relates to a liquid container, an ink jet cartridge and an ink jet printing apparatus.

2. Related Background Art

For ink jet printing apparatuses, a large number of means for supplying ink to an ink jet print head have been proposed and in practical use. The most traditional ink supply method for ink jet printing apparatuses is a tube supply method of supplying ink from an ink tank in the printing apparatus to a print head on a cartridge via a tube. However, according to such a tube supply method, the movement of the cartridge affects the flow of the ink in the tube in the direction in which the carriage moves, so that the ink may be ejected unstably from the print head. Thus, oscillation of the ink in the tube must be suppressed in order to increase printing speed.

Further, the tube supply method has various problems associated with the need for a tube long enough to allow the carriage to be reciprocated. For example, to avoid inconveniences attributed to the entry of air into the tube during a long-time storage, a large amount of ink from an ink supply source (an ink tank) must be allowed to flow through the tube when the printing apparatus is initially used or in other cases. Moreover, the above described tube is used as only a path through which ink from the ink tank is supplied to the print head. Thus, the tube does not only have a smaller added value but also results in an increase in the size and cost of the printing apparatus and a complication of the structure, or the like.

To omit such an ink supply tube, an ink jet printing apparatus of FIG. 15 has been developed which employs a so-called head-tank-on carriage method. The ink jet printing apparatus 100 shown in FIG. 15 comprises an ink jet cartridge 101 including an ink jet print head and an ink tank detachable from the print head. The ink jet cartridge 101 is installed onto a carriage 103 that can reciprocate in a main scanning direction while being guided by a guide shaft 102. The ink jet printing apparatus 100 alternately repeats an operation of ejecting ink from the print head in the ink jet cartridge 101 on the basis of print data and an operation of conveying a print medium P in a sub-scanning direction perpendicular to the main scanning direction.

The ink jet printing apparatus 100 includes a capping unit 104 that caps ink nozzles of the print head of the ink jet cartridge 101. A recovery process (preliminary ejection) for maintaining an appropriate ink ejection state can be executed by making the print head eject ink not contributing to image printing on the capping unit 104. Further, a suction recovery process for maintaining an appropriate ink ejection state can be executed by generating negative pressure in the capping unit 104, which caps the ink nozzles of the print head, to forcibly suck ink from the ink nozzles of the print head. The print head of the ink jet cartridge 101 includes, for example, electrothermal converting elements in order to eject ink droplets through the ink nozzles. In this case, the electrothermal converting elements generate heat to subject the ink to film boiling. The print head ejects ink droplets through the ink nozzles using thermal energy generated by the electrothermal converting elements.

In the head-tank-on carriage method, the ink supply path is formed between the print head and ink tank of the ink jet cartridge 101. This enables the configuration of the ink supply path to be significantly simplified. Further, the ink supply path is integrally incorporated in the print head or the ink tank, so that the size and costs of the apparatus can be reduced and a shorter ink supply path can be designed. It is also possible to drastically reduce a portion of the ink supply path extending in parallel with the movement direction of the carriage 104. This effectively suppresses unstable ink ejection attributed to the oscillation of ink in the ink supply path during high-speed printing.

However, in the head-tank-on carriage method, if a large amount of ink is stored in the carriage, the capacity of the ink tank constituting the ink jet cartridge must necessarily be increased. An increase in the size and/or weight of the ink jet cartridge increases the weight of the entire carriage, on which the ink jet cartridge is installed. This may increase the size of a motor that drives the carriage, driving power, and the size and weight of the entire printing apparatus. On the other hand, for small-sized ink jet printing apparatuses, it is desirable to minimize the size of the carriage. Accordingly, the capacity of the ink tank installed on the carriage is limited to an extremely small value. In such a case, the user must frequently replace the ink tank on the carriage. However, the frequent replacement of the ink tank does not satisfy demands for user-friendly apparatuses and environment preservation.

Ink jet printing apparatuses employing a so-called pit-in method are known to be able to solve above described problems. In the ink jet printing apparatus using the pit-in system, an ink supply to the sub-tank is performed as follows. At first, the carriage is moved to a predetermined ink supply position, for example, an end of the movement passage of the carriage. At the ink supply position, the sub-tank is connected to a main tank if necessary and is connected to a pump. Then, a negative pressure is created in the sub-tank by the pump to draw ink from the main tank into the sub-tank by suction. Further, the sub-tank on the carriage is filled with ink from a main tank provided in the printing apparatus. With such a pit-in method, the weight of the entire carriage is reduced to enable the print head to carry out high-speed scanning. As a result, high-speed printing is achieved. Further, as long as the sub-tank is filled with ink from the main tank, the number of sheets printed is not limited. Furthermore, it is unnecessary to have such a tube as is required for the above described tube supply method. This simplifies the configuration of the entire apparatus.

The most important technical point of such a pit-in method is how to reliably fill the sub-tank with ink. That is, the most important point is how to supply ink from the main tank to the sub-tank during a pit-in operation at the home position.

An example of such an ink supply method used during a pit-in operation is a method of providing a sensor in the sub-tank to detect the amount of ink and supplying ink to the sub-tank in accordance with the detected amount of ink. However, a mechanism for this method is very complicated, delicate, and expensive. To solve this problem, a method is known including sucking all ink from the sub-tank during a pit-in operation and subsequently filling the sub-tank with ink. This method eliminates the need to add means for detecting the amount of ink in the sub-tank. However, the total amount of waste ink sucked from the sub-tank during each pit-in operation is not negligible. Thus, it is necessary to increase the size of area in which the waste ink is stored. Also, tight design restrictions are imposed on, in particular, small-sized ink jet printing apparatuses.

To solve these problems, a pit-in-method-based ink supply means has been proposed which employs a gas liquid separation member as shown in FIGS. 16 and 17. The example shown in these drawings blocks the flow of a liquid (ink), while utilizing the nature of the gas liquid separation member, which allows a gas such as air to pass through. In this case, before the carriage moves to the home position, a sub-tank unit 200 on the carriage is separated from an ink supply recovery unit 201 of a main tank disposed at a predetermined position of the printing apparatus, as shown in FIG. 16. In the state shown in FIG. 16, the level L of ink in a container main body 206 is low.

An ink absorbing member 224 is accommodated in the container main body 206 of the sub-tank unit 200. Ink in the container main body 206 is supplied to the ink jet print head 226 through a filter 225. A suction path is formed in the upper part of the container main body 206 and is in communication with a suction port 227 via a gas liquid separation member 223. Further, the sub-tank unit 200 has a hollow needle 222 that is in communication with the suction port 227. On the other hand, the ink supply recovery unit 201 has a suction joint 229 that can be connected to the suction port 227 of the unit 200 and is connected to a suction pump (not shown). Further, a supply joint 230 is disposed close to the suction joint 229 and can be connected to the hollow needle 222 of the unit 200. The supply joint 230 is connected to the main tank (not shown) via an ink supply path. An air communication passage opened and closed by a valve body 228 and a suction path connected to the suction pump are connected to a cap 208 that can cap the print head 226.

During a pit-in operation, the units 200 and 201 are moved closer to each other and then coupled together as shown in FIG. 17. Then, ink from the unit 201 in the main tank is supplied to the unit 200 in the sub-tank. That is, as shown by the solid arrow in FIG. 17, the suction pump sucks air from the container main body 206 of the unit 200 through the suction joint 229, the suction port 227, and the gas liquid separation member 223. As a result, negative pressure is generated in the container main body 206. Accordingly, as shown by the dotted arrow in FIG. 17, ink from the main tank is introduced into the container main body 206 through the supply joint 230 and the hollow needle 222. Once the level L of ink in the container main body 206 rises to the level of the gas liquid separation member 223, the gas liquid separation member 223 starts to block the passage of ink. Consequently, the ink supply is automatically stopped.

The amount of air sucked by the suction pump has only to be at least the internal volume of the container. By sucking air from the container main body 206, the air is discharged from the container main body 206 through the gas liquid separation member 223 regardless of the amount of ink remaining in the container main body 206. Instead, ink from the main tank is supplied into the container main body 206. That is, to fill the container main body 206 with ink, a specified or larger amount of air has only to be sucked from the container main body 206 through the gas liquid separation member 223. Thus, it is unnecessary to control the sucking of air. In principle, the inside of the container main body 206 can be filled with ink by designing the suction pump with a sufficient margin.

Recently, ink jet printing apparatuses have accomplished remarkable advances. It is also common to implement high-definition color images having photograph quality. Further, with the expansion of the markets, there are growing demands for more inexpensive printing apparatuses with higher quality. Naturally, such demands also exist for small-sized and pit-in-method-based printing apparatuses previously described. Such demands for colored and more inexpensive printing apparatuses pose various problems in actually applying a configuration as shown in FIGS. 16 and 17.

That is, if the configuration of FIGS. 16 and 17 is applied to a pit-in-method-based printing apparatus capable of color printing, sub-tanks (ink containers) for a plurality of colors and pit-in structures for the respective colors must be provided to allow the multiple colors to be simultaneously printed. Further, in this case, if providing relatively expensive gas liquid separation member for each of the ink absorbing members, the number of sub-tank unit components and the number of assembly steps increase. Thus, it is difficult to reduce the costs of the printing apparatus. Further, when the gas is sucked from the ink absorbing members via the gas liquid separation members, ink is likely to be attached to the gas liquid separation members. In this case, if the ink remains on the gas liquid separation members, the characteristic (suction characteristic) of ventilation through the gas liquid separation members is deteriorated. Thus, it is difficult to stabilize the supply of ink to the ink absorbing members in the sub-tanks and maintain reliability.

To solve the above described problem associated with the number of gas liquid separation members, it is contemplated that a single common gas liquid separation member may be provided for each of the ink absorbing members. However, even this configuration fails to solve the problem that ink remains on the gas liquid separation members as described above. Alternatively, to prevent ink from remaining on the gas liquid separation members, it is contemplated that the shape of the ink absorbing members is modified so that ink easily returns from the gas liquid separation members to the ink absorbing members. However, in this case, the shape of the ink absorbing members becomes complicated, thus increasing the costs of the sub-tank unit and thus the entire printing apparatus. Furthermore, the gas liquid separation members may interfere with the ink absorbing members and vice versa. This may cause the leakage of ink or internal air.

SUMMARY OF THE INVENTION

The present invention provides a liquid container, an ink jet cartridge, and an ink jet printing apparatus which can solve one or more of the above described problems.

A liquid container according to the present invention comprises: a container main body having a liquid storage for storing the liquid; a ventilation path enabling the liquid storage and an outside of the container main body to communicate with each other; a gas liquid separation member disposed to communicate with the ventilation path; and a capillary member generating a capillary force, the capillary member disposed between the liquid storage and the gas liquid separation member.

An ink jet cartridge according to the present invention comprises: an ink jet print head capable of ejecting ink for image printing; an ink container for the ink fixed or detachably connected to the ink jet print head, the ink storage container including: a container main body having a ink storage for storing the ink; a ventilation path enabling the ink storage and an outside of the container main body to communicate with each other; an ink intake port allowing the ink storage to communicate with the outside of the container main body, a gas liquid separation member disposed to communicate with the ventilation path; and a capillary member generating a capillary force, the capillary member disposed between the ink storage and the gas liquid separation member.

An ink jet printing apparatus according to the present invention comprises above described ink jet cartridge. In the ink jet printing apparatus, a pressure in the ink storage is reduced by sucking a gas from the ink storage via the ventilation path, the gas liquid separation member and the capillary member, so that the liquid can be supplied into the ink storage via the ink intake port.

According to the present invention, it is possible to inexpensively construct a liquid container for containing the liquid such as ink as well as an ink jet cartridge and a printing apparatus both provided with the liquid container, and to improve the stability and reliability of supply of the liquid to the container.

The above and other objects, effects, features and advantages of the present invention will become more apparent from the following description of embodiments thereof taken in conjunction with the accompanying drawings.

DESCRIPTION OF THE PREFERRED EMBODIMENT

Figure 1:
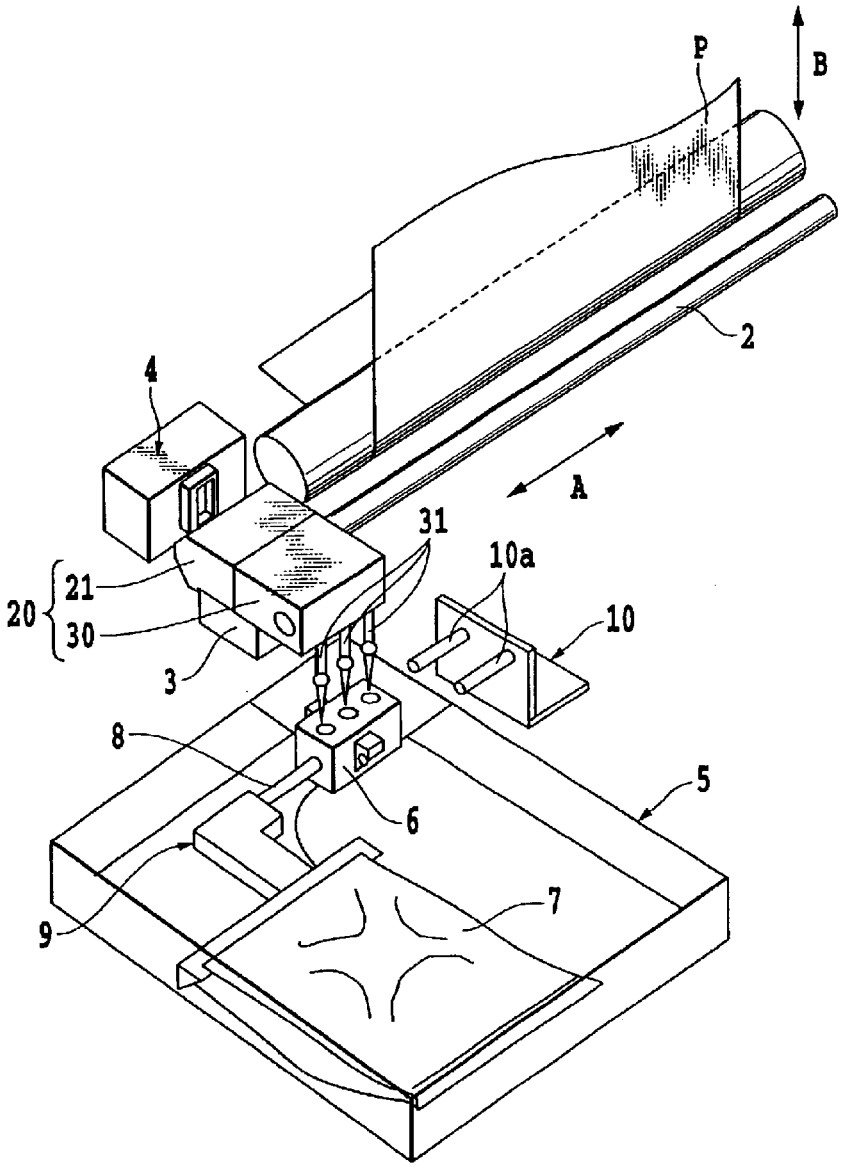
FIG. 1 is a perspective view showing an ink jet printing apparatus according to the present invention.

One aspect of the present invention relates to a liquid container capable of containing a predetermined liquid such as ink for ink jet printing. The liquid container comprises a container main body having liquid storage, a ventilation path enabling the liquid storage and an outside of the container main body to communicate with each other, and a gas liquid separation member disposed to communicate with the ventilation path. The liquid storage preferably includes a liquid absorbing member capable of absorbing and storing the liquid. The liquid container has capillary member that generates a capillary force and disposed between the liquid storage and the gas liquid separation member. Preferably, the capillary member has a porous structure or a hole in order to generate capillary force. The capillary force of the capillary member is preferably set to be weaker than that of the liquid absorbing member. Preferably, at least part of an end surface of the capillary member on the side of the gas liquid separation member is in contact with the gas liquid separation member.

In the liquid container of the present invention, the pressure in the liquid storage is reduced by sucking a gas from the liquid storage of the container main body via the ventilation path, the gas liquid separation member, and the corresponding capillary members. As a result, the liquid can be reliably introduced into the liquid storage via a communication port or the like allowing the liquid storage to communicate with the outside of the container main body. Further, in this configuration, by appropriately selecting the characteristics (capillary force), shape, arrangement, and the like of the capillary member between the gas liquid separation member and the liquid storage, the liquid having reached the gas liquid separation member owing to suction can be quickly returned to the liquid storage through the capillary member after ink filling has been automatically stopped. Accordingly, it is possible to prevent ink from remaining on the gas liquid separation member, so that a suction characteristic through the gas liquid separation member can be kept appropriate. Also, ink can be supplied more stably and reliably to the liquid storage. Further, the structure of the liquid storage (the shape of the liquid absorbing members) can be simplified and an easy and flexible arrangement of the components of the liquid container can be achieved. Moreover, in the liquid container, the leakage of the ink or internal gas can be reliably prevent because the gas liquid separation member and the ink absorbing members do not directly interfere with each other. As a result, according to the present invention, it is possible to inexpensively construct the liquid container for containing the liquid such as ink as well as an ink jet cartridge and a printing apparatus both provided with the liquid container, and to improve the stability and reliability of supply of the liquid to the container.

As described above, the liquid storage preferably includes the liquid absorbing member that can absorb the liquid, so that the inside of the liquid storage can be always maintained at a negative pressure. In this case, the liquid can be introduced and held reliably in the liquid storage, and an oscillation of the ink in the liquid storage due to an inertia force can be prevented when the liquid container is moved.

Further, the capillary force of the capillary member (porous member) is preferably set to at least 50 Pa and at most 500 Pa. By setting the capillary force of the capillary member to such a range, practically desirable results can be obtained while appropriately generating capillary force.

Furthermore, the capillary member preferably includes a hole extending from one end surface to the other end surface thereof. The hole preferably includes a narrowed portion having a width of 1 mm or less.

Preferably, a plurality of liquid absorbing members are arranged in the container main body. In this case, the capillary member is disposed for each of the liquid absorbing members, and a single gas liquid separation member is disposed between each of the capillary members and the ventilation path. That is, the single gas liquid separation member is shared by each of the liquid absorbing members.

In this configuration, it is unnecessary to individually provide relatively expensive gas liquid separation member for each of the ink absorbing members. Accordingly, increases in the numbers of components and assembly steps can be suppressed to reduce the costs of the liquid container and thus the entire apparatus to which the liquid container is applied. Also, in this configuration, by appropriately selecting the characteristics (capillary force), shape, arrangement, and the like of the capillary members between the single gas liquid separation member and the liquid absorbing members, the liquid having reached the gas liquid separation member owing to suction can be quickly returned to the liquid absorbing members through the capillary members after ink filling has been automatically stopped. Accordingly, the structure of the liquid storages (the shape of the liquid absorbing members) can be simplified and an easy and flexible arrangement of the components of the liquid container can be achieved. Moreover, in the liquid container, the leakage of the ink or internal gas can be reliably prevent because the gas liquid separation member and the ink absorbing members do not directly interfere with each other. As a result, it is possible to inexpensively construct the liquid container, a printing apparatus provided with the liquid container, and the like and to allow the liquid to be supplied more stably and reliably to the container.

Another aspect of the present invention relates to an ink jet cartridge. This ink jet cartridge comprises an ink jet print head capable of ejecting ink for image printing and an ink container for the ink fixed or detachably connected to the ink jet print head. The ink storage container includes: a container main body having a ink storage for storing the ink; a ventilation path enabling the ink storage and an outside of the container main body to communicate with each other; an ink intake port allowing the ink storage to communicate with the outside of the container main body, a gas liquid separation member disposed to communicate with the ventilation path; and a capillary member generating a capillary force, the capillary member disposed between the ink storage and the gas liquid separation member.

Preferably, the ink jet cartridge further comprises a plurality of ink absorbing members arranged in the container main body so that the ink can be stored in each of the ink absorbing members. In this case, the capillary member is disposed for each of the ink absorbing members, and single gas liquid separation member is disposed between each of the capillary members and the ventilation path.

Another aspect of the present invention relates to an ink jet printing apparatus provided with the above described ink jet cartridge. In this ink jet printing apparatus, a pressure in the ink storage is reduced by sucking a gas from the ink storage via the ventilation path, the gas liquid separation member and the capillary member, so that the liquid can be supplied into the ink storage via the ink intake port.

In this ink jet printing apparatus, the ink jet print head of the ink jet cartridge preferably includes an electrothermal converting element for generating thermal energy and ejects ink droplets using thermal energy generated by the electrothermal converting element.

Now, preferred embodiments of the liquid container, the ink jet cartridge and the ink jet printing apparatus according to the present invention will be described in detail with reference to the accompanying drawings.

FIG. 1 is a perspective view showing an ink jet printing apparatus according to the present invention. The ink jet printing apparatus 1 of FIG. 1 employs a so-called pit-in method. The printing apparatus 1 includes a carriage 3 capable of reciprocating in a main scanning direction while being guided by a guide shaft 2. An ink jet cartridge 20 is mounted on the carriage 3. The ink jet cartridge 20 includes a sub-tank unit (ink container) 30 and an ink jet print head 21 fixed or detachably connected to the sub-tank unit 30. The print head 21 can eject ink from the sub-tank unit 30.

The print head 21 of the ink jet cartridge 20 includes a plurality of electrothermal converting elements for ejecting ink droplets through ink nozzles thereof. The electrothermal converting elements of the print head 21 generate heat to subject ink to film boiling. The print head 21 ejects ink droplets using thermal energy generated by the electrothermal converting elements. The ink jet printing apparatus 1 moves the carriage 3 together with the ink jet cartridge 20 in the main scanning direction shown by arrow A of FIG. 1, while causing the print head 21 of the ink jet cartridge 20 to eject ink droplets in accordance with print data. The ink jet printing apparatus 1 also feeds a print medium P in a sub-scanning direction substantially perpendicular to the main scanning direction. As a result, a desired image is printed on the print medium P. Further, the ink jet printing apparatus 1 includes a capping unit (not shown) that can cap the ink nozzles of the print head 21 of the ink jet cartridge 20.

As a printing operation progresses, the ink in the sub-tank unit 30 is consumed. Once the amount of ink remaining in the sub-tank unit 30 reaches a predetermined value or less, the carriage 3 is moved to a predetermined home position as shown in FIG. 1. At this home position, ink from a main tank unit 5 is supplied to the sub-tank unit 30. Once the sub-tank unit 30 is filled sufficiently with ink, the printing operation is resumed. When ink from the main tank unit 5 is supplied to the sub-tank unit 30, the sub-tank unit 30 is coupled with a connector 6 of the main tank unit 5. Further, suction means (for example, a suction pump) is connected to the sub-tank unit 30 via a predetermined pipe or the like.

Here, the sub-tank unit 30 can contain ink of three colors including yellow (Y), magenta (M), and cyan (C). The sub-tank unit 30 has hollow needles 31 for each of the colors, which are used to supply the ink. The main tank unit 5 includes bags 7 for each of the colors (only one is shown in FIG. 1). Each of the bags 7 is connected to the connector 6 via an ink channel 9 including a flexible tube 8. When ink is supplied, a moving member 10 is moved substantially parallel with the guide shaft 2. Then, arms 10*a* of the moving member 10 are coupled to the connector 6. Subsequently, the moving member 10 moves in the vertical direction to connect the connector 6 with the hollow needles 31 of the sub-tank unit 30.

In the above described ink jet printing apparatus 1, it is possible to reduce the weight of the entire carriage 3 for supporting the ink jet cartridge 20 including the print head 21 and the sub-tank unit 30 of a small capacity. Accordingly, the print head 21 can be scanned at high speed to achieve high-speed printing. Further, as long as the sub-tank unit 30 is filled with ink from the main tank unit 5, the number of print media P printed is not limited. Furthermore, it is unnecessary to have such a tube as is required by a printing apparatus based on the tube supply method. This simplifies the configuration of the entire apparatus.

Figure 2:
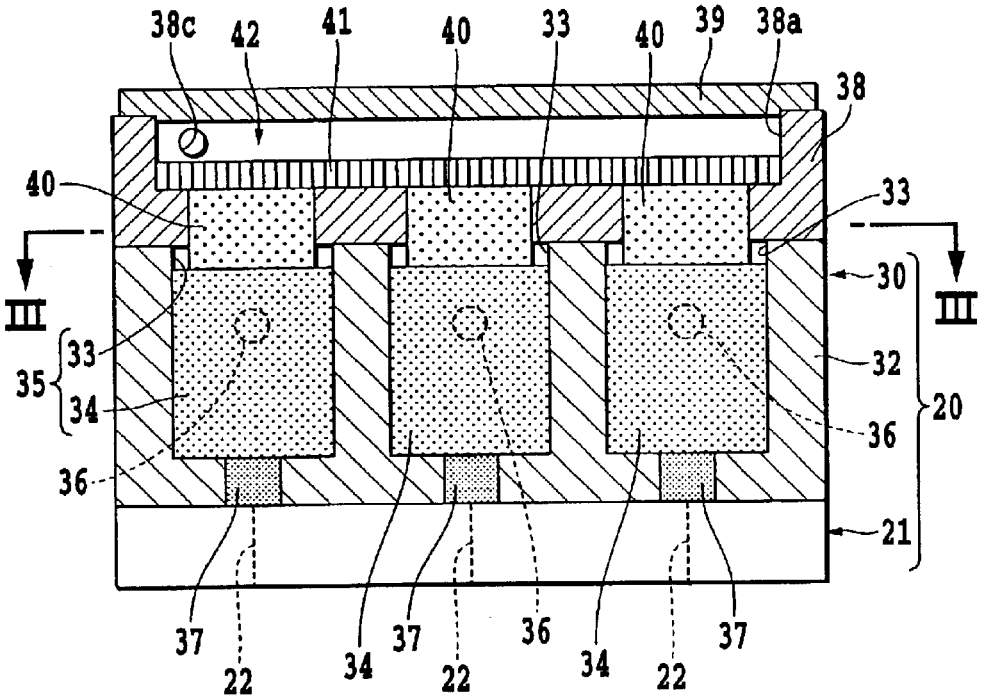
FIG. 2 is a partial sectional view showing an ink jet cartridge of the ink jet printing apparatus of FIG. 1.

FIG. 2 is a partial sectional view showing the ink jet cartridge 20 including the sub-tank unit 30. As shown in FIG. 2, the sub-tank unit 30 includes a container main body 32. As described above, the sub-tank unit 30 can independently store ink of the three colors (Y, M, and C). Thus, three rectangular chambers 33 are formed in the container main body 32. Each of the chambers 33 has an opened top portion as shown in FIG. 2.

An ink absorbing member (liquid absorbing member) 34 such as a sponge capable of absorbing liquids is disposed in each of the chambers 33. When ink of each color is stored in the sub-tank unit 30, the ink absorbing members 34 respectively absorb ink of the different colors. A material for the ink absorbing members 34 may be high-density foam such as urethane, polypropylene, polyethylene, polytetrafluoroethylene, or cellulose. Of course, the material for the ink absorbing members 34 may be optionally selected depending on the kind of the ink, the material for the container main body 32, or the like. Each of the ink absorbing members 34 is formed so as to fit into the corresponding chamber 33. In this embodiment, each of the ink absorbing members 34 has a rectangular shape. Further, the height of the ink absorbing member 34 is set to be smaller than that of the chamber 33 as shown in FIG. 2.

Each ink absorbing member 34 constitutes an ink storage 35 (liquid storage means) 35 of the sub-tank unit 30 (container main body 32) together with the corresponding chamber 33. Since each ink storage 35 includes the ink absorbing member 34, the inside of the ink storage 35 (chamber 33) is always maintained at a negative pressure. Thus, the liquid can be introduced and held reliably in each liquid storage 35. Furthermore, an oscillation of the ink in the liquid storage 35 due to an inertia force can be prevented when the sub-tank unit 30, i.e. the ink jet cartridge 20 is moved for a printing operation, The container main body 32 has ink intake ports (communication ports) 36 for each of the chambers 33. Each ink intake port 36 is connected to the above described hollow needle 31. Further, the container main body 32 has three filters 37 disposed so as to lie under the corresponding chambers 33 (i.e. the lower part of FIG. 2). Each ink storage 35 is connected with an ink channel 22 formed in the print head 21 via the corresponding filter 37. Each ink channel 22 is in communication with corresponding ink nozzles (not shown) of the print head 21.

Figure 3:
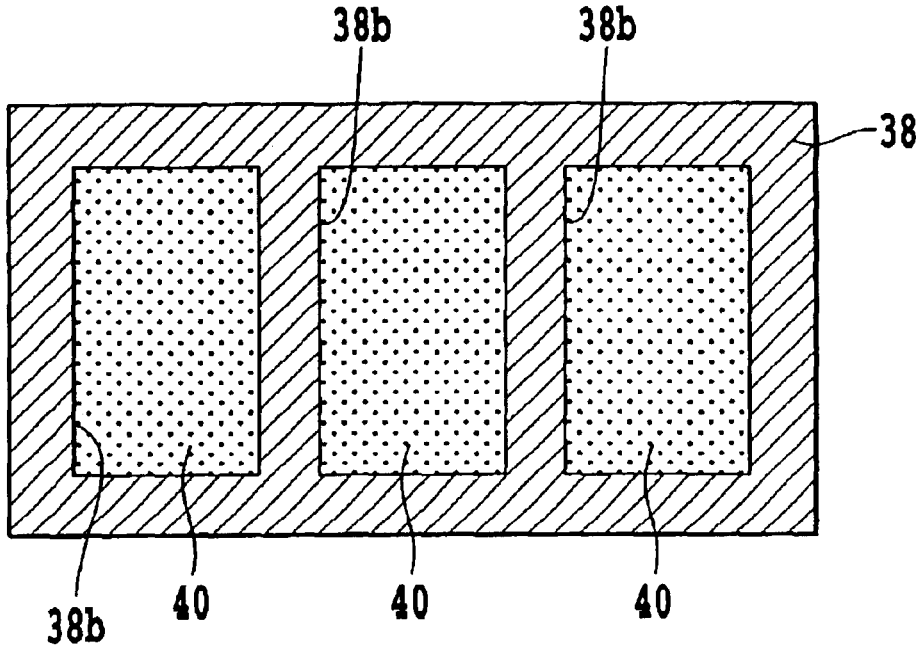
FIG. 3 is a sectional view taken along line III—III in FIG. 2.

As shown in FIG. 2, a middle cover 38 is mounted on the container main body 32 and a top cover 39 is mounted on the middle cover 38. The middle cover 38 has a hollowed portion 38*a* and three openings 38*b* corresponding to the chambers 33 as shown in FIG. 3. Capillary member 40 is disposed within each of the openings 38*b* of the middle cover 38. In the present embodiment, each of the capillary members 40 is fitted into the corresponding opening 38*b* without any clearances. In this embodiment, the capillary force of the capillary member 40 is weaker than that of the ink absorbing member 34. That is, a material for the capillary member 40 is selected from various porous members which satisfy this condition. As shown in FIG. 2, one end surface (the lower end surface in FIG. 2) of each capillary member 40 as a whole is in contact with an end surface of the corresponding ink absorbing member 34.

Further, a single gas liquid separation member (gas liquid separation film) 41 is fixed to the top surface of the hollowed portion 38*a* of the middle cover 38 by adhesion or welding. The gas liquid separation member 41 is formed like a thin flat plate. In this way, the sub-tank unit 30 includes the single gas liquid separation member 41 for each of the ink absorbing members 34. Thus, it is unnecessary to individually provide relatively expensive gas liquid separation member for each of the ink absorbing members 34. Accordingly, increases in the numbers of components and assembly steps can be suppressed to reduce the costs of the sub-tank unit 30 (ink jet cartridge 20) and thus the entire printing apparatus 1. The other end surface (the upper end surface in FIG. 2) of each of the above described capillary members 40 as a whole is in contact with the gas liquid separation member 41.

The gas liquid separation member 41 has a characteristic to allow a gas such as air to pass therethrough, while blocking the flow of a liquid such as ink. Accordingly, if there are no gaps between the middle cover 38 and the container main body 32, ink does not leak from each ink storage 35 over the middle cover 38. Further, as seen from FIG. 3, the openings 38*b* are arranged in the middle cover 38 at a predetermined interval. Accordingly, even though the three chambers 33 are covered with the single gas liquid separation member 41, the partition wall between the openings 38*b* prevent the ink from being mixed together. Furthermore, as described above, the height of the ink absorbing member 34 is set to be smaller than that of the chamber 33. Accordingly, when the middle cover 38 is attached to the container main body 32, none of the ink absorbing members 34 are sandwiched between the container main body 32 and the middle cover 38. This prevents the direct interference between the ink absorbing members 34 and the gas liquid separation member 41, thus reliably preventing the leakage of the ink or internal gas.

The top cover 39 is fixed to the middle cover 38 by adhesion or welding as shown in FIG. 2. Thus, a space (ventilation path) 42 is defined between the middle cover 38 and the top cover 39. Further, a suction port 38*c* communicating with the outside of the space 42 is formed in a side wall portion of the middle cover 38. By connecting a suction means such as a suction pump to the suction port 38*c* and then activating the suction means, ink can be introduced into each ink storage 35 via the corresponding ink intake port 36.

Now, description will be given of an operation of supplying ink to the sub-tank unit 30 included in the ink jet cartridge 20 of the ink jet printing apparatus 1.

As described above, once the amount of ink remaining in the sub-tank unit 30 reaches a predetermined value or less, the carriage 3 is moved to the home position as shown in FIG. 1. When the carriage 3 is stopped at the home position, the suction means such as a suction pump is connected to the suction port 38*c* included in the sub-tank unit 30 of the ink jet cartridge 20. Further, the hollow needles 31 of the sub-tank unit 30 are connected to the connectors 6 of the main tank unit 5 in accordance with the above described procedure.

When the suction means is activated, the gas is sucked from each ink storage 35 of the container main body 32, i.e. from the ink absorbing members 34 via the suction port 38*c*, the space (ventilation path) 42, the gas liquid separation member 41, and each of the capillary members 40. Thus, the pressure in each ink storage 35 is reduced through the capillary member 40 and others. As a result, ink from the main tank unit 5 is reliably introduced into (absorbed by) each of the ink absorbing members 34 via the hollow needle 31 and ink intake port 36, and others.

Figure 4:
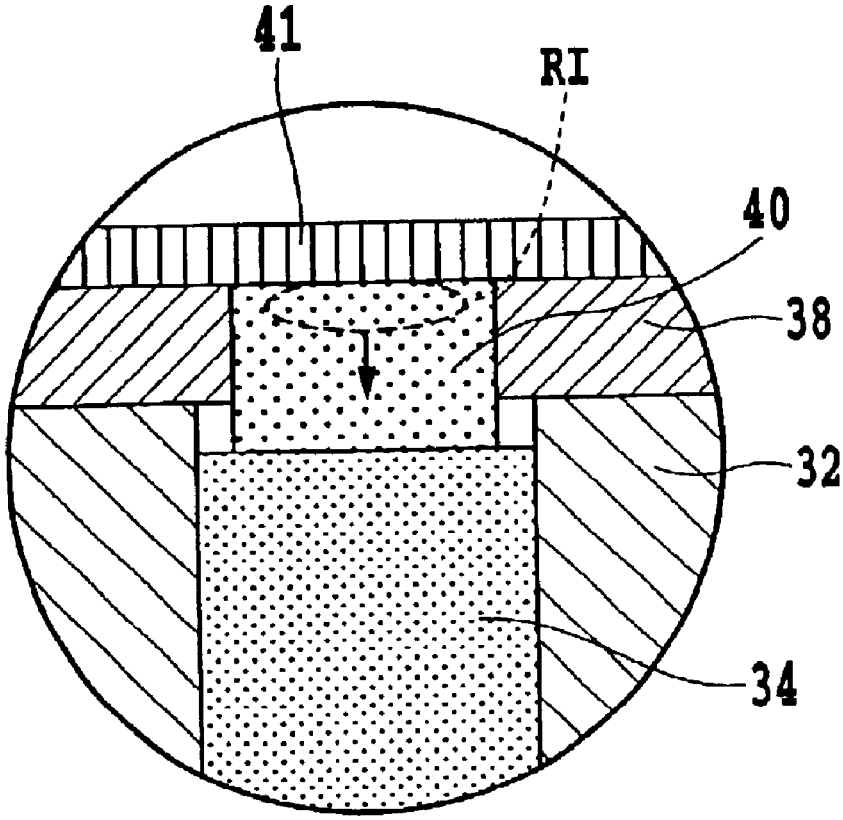
FIG. 4 is a schematic diagram illustrating the flow of ink in a sub-tank unit included in the ink jet cartridge of FIG. 2.
Figure 5:
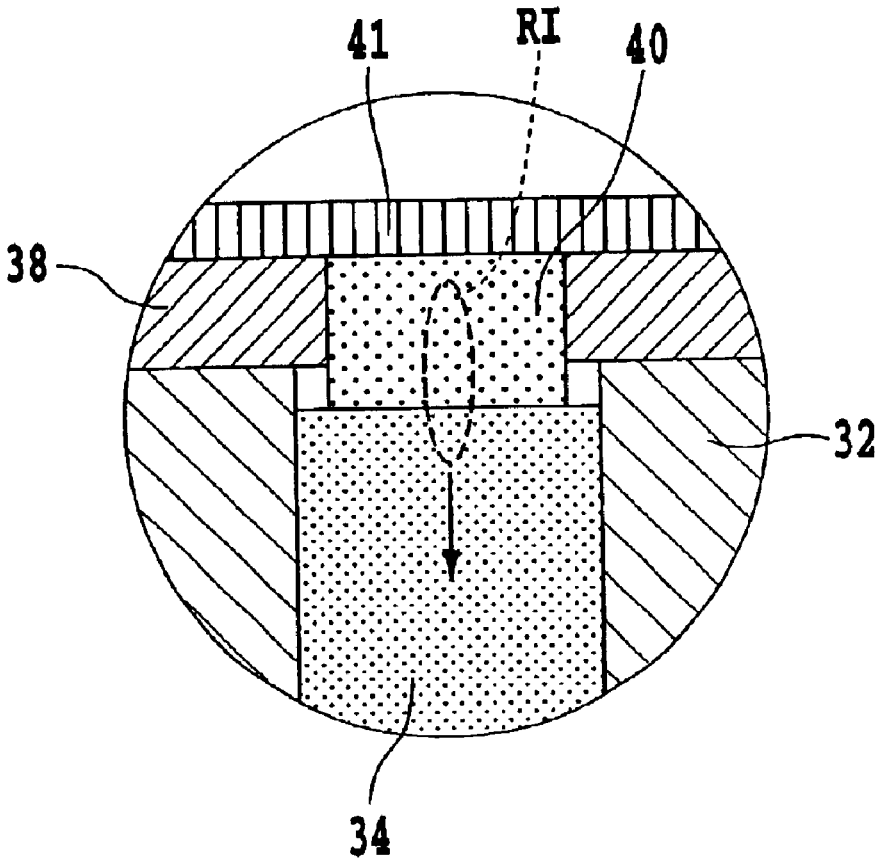
FIG. 5 is a schematic diagram illustrating the flow of ink in the sub-tank unit included in the ink jet cartridge of FIG. 2.

Once the level of the ink in each ink storage 35 rises up to the level of the gas liquid separation member 41, the gas liquid separation member 41 blocks the passage of the ink, so that the ink supply is automatically stopped. While the gas is being sucked from each ink storage 35, if the ink is raised up to the vicinity of the interface between the gas liquid separation member 41 and the ink absorbing members 34 as shown in FIG. 4, the ink may remain in this place. However, in the sub-tank unit 30, the capillary force of the capillary member 40 is set to be weaker than that of the ink absorbing member 34 as described above. Further, each capillary member 40 is disposed between the corresponding ink absorbing member 34 and the gas liquid separation member 41 so as to contact with both of them. Accordingly, the ink RI remaining in the vicinity of the above interface is sucked quickly owing to the capillary force of the capillary member 40, so that the ink RI quickly returns to the ink absorbing member 34.

As described above, according to the sub-tank unit (liquid container) 30 of the present invention, ink can be reliably prevented from remaining in the vicinity of the gas liquid separation member 41. This makes it possible to maintain the appropriate suction through the gas liquid separation member 41. Consequently, ink can be supplied much more stably and reliably to each liquid storage 35. Further, since each capillary member 40 is interposed between the corresponding ink storage 35 (ink absorbing member 34) and the gas liquid separation member 41, the structure of the liquid storage 35 (the shape of the liquid absorbing members 34) can be simplified and an easy and flexible arrangement of the components of the sub-tank unit 30 can be achieved. Furthermore, in the sub-tank unit 30, the leakage of the ink or internal gas can be reliably prevent because the gas liquid separation member 41 and the ink absorbing members 34 do not directly interfere with each other. As a result, according to the present invention, it is possible to inexpensively construct the sub-tank unit 30, the ink jet cartridge 20 and the printing apparatus 1 with the sub-tank unit 30 and to allow the liquid to be supplied more stably and reliably to the sub-tank unit 30.

In the above described configuration, to stabilize the ejection of ink in the ink jet printing apparatus 1 (ink jet cartridge 20), a constant negative pressure must be generated at the nozzles of the ink jet print head 21. This negative pressure results from the capillary force of each ink absorbing member 34. In general, the capillary force of the ink absorbing member 34 is desirably at least about 500 Pa (about 50 mmAq). In view of these points, the capillary force of the capillary member (porous member) 40 is preferably set to at least 50 Pa (about 5.0 mmAq) and at most 500 Pa, more preferably at least 50 Pa and at most 300 Pa. Then, very good results in a practical use can be obtained while appropriately generating capillary force. It should be appreciated that to accomplish the above described operations, at least part of the end surface of each capillary member 40 has only to be in contact with the gas liquid separation member 41.

A second embodiment of a liquid container according to the present invention will be described below with reference to FIGS. 6 to 8. The same elements as those described with reference to the first embodiment are referred to same reference numerals and same description will be omitted.

Figure 6:
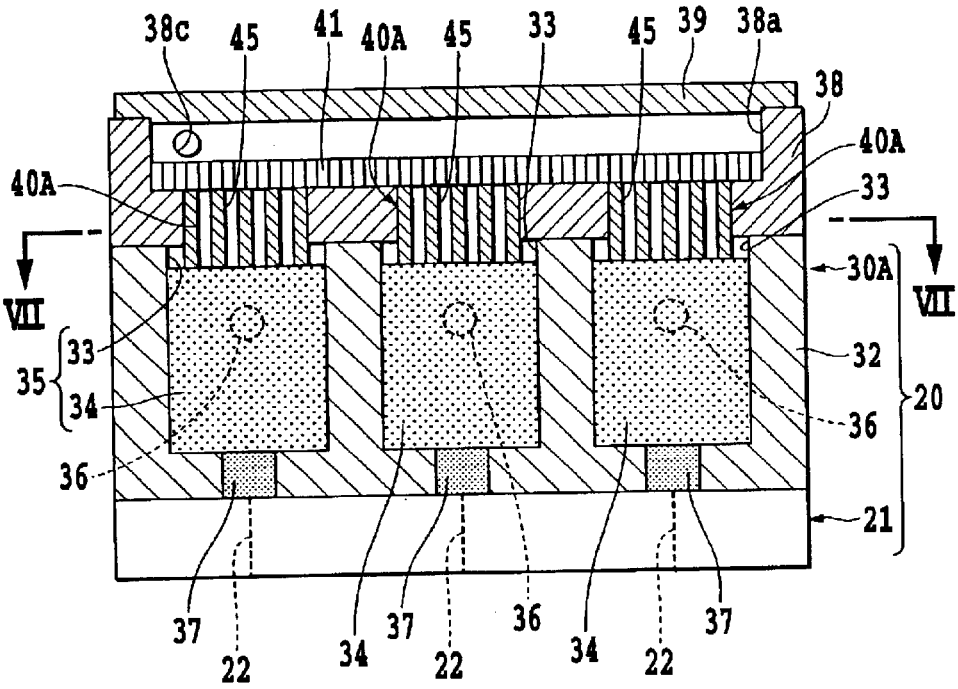
FIG. 6 is a partial sectional view showing an ink jet cartridge provided with a sub-tank unit of a second embodiment of a liquid container according to the present invention.
Figure 7:
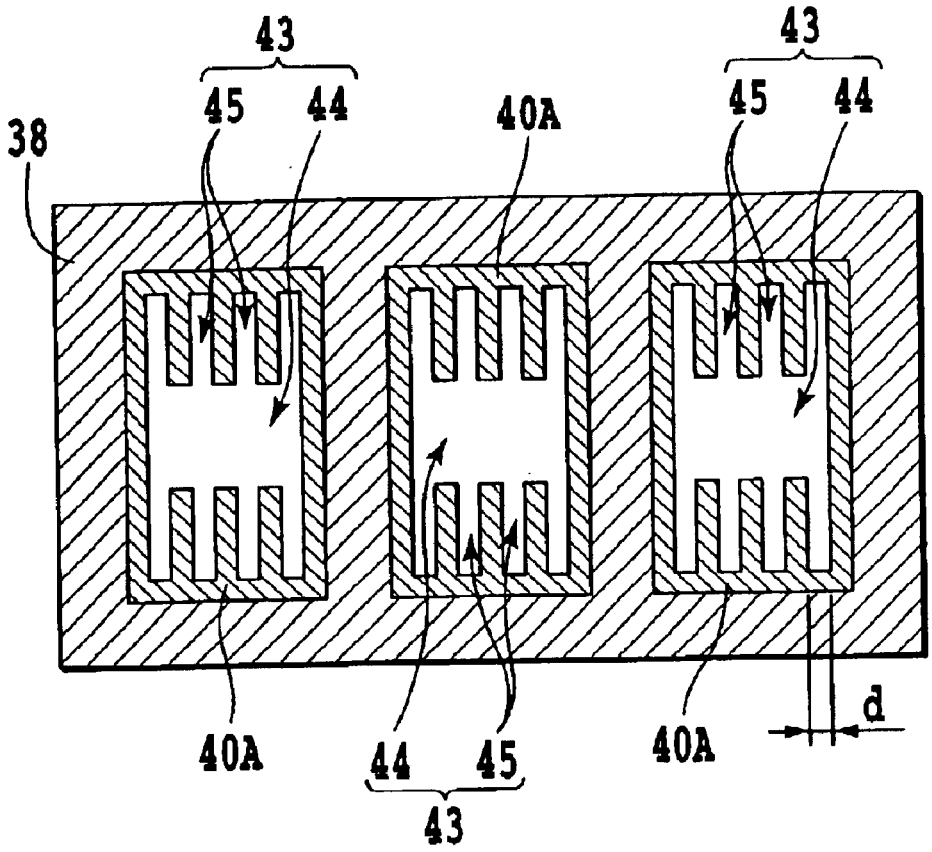
FIG. 7 is a sectional view taken along line VII—VII in FIG. 6.

A sub-tank unit 30A of FIG. 6 has a configuration basically similar to that of the above described sub-tank unit 30 but includes capillary members 40A different from the capillary members 40 of the sub-tank unit 30. As shown in FIGS. 6 and 7, each of the capillary members 40A has a penetration hole 43 extending from one end surface (end surface opposing to the gas liquid separation member 41) to the other end surface (end surface opposing to the ink absorbing member 34) of the capillary member 40A. The hole 43 includes a central portion 44 having a generally rectangular cross section and a plurality of narrowed portions (slit) 45 extending from an edge of the central portion 44 longitudinally outward in the cross section of the structure. The capillary members 40A having the hole 43 (central portion 44 and narrowed portions 45) can be formed by injecting resin, die-casting or machining metal, or the like.

Each of the capillary members 40A is disposed between the ink absorbing member 34 of the corresponding ink storage 35 and the gas liquid separation member 41. Each of the capillary members 40A is also in contact with both corresponding ink absorbing member 34 and gas liquid separation member 41. Further, the width of each narrowed portion 45 is set so that the capillary members 40*a* have a weaker capillary force than the ink absorbing members 34. In the present embodiment, each capillary member 40A is separate from the middle cover 38 and is fitted into the corresponding opening 38*b*. However, the present invention is not limited to this. That is, the capillary members 40A may be integrated with the middle cover 38.

Figure 8A:
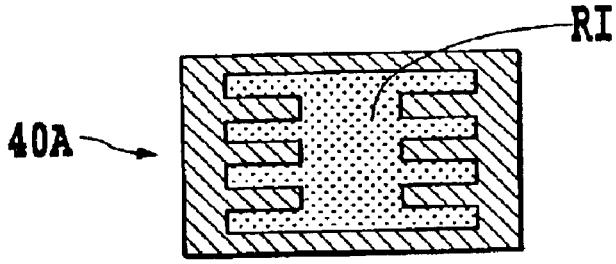
FIGS. 8A, 8B, 8C, and 8D are schematic diagrams illustrating the flow of ink in the sub-tank unit included in the ink jet cartridge of FIG. 6.
Figure 8B:
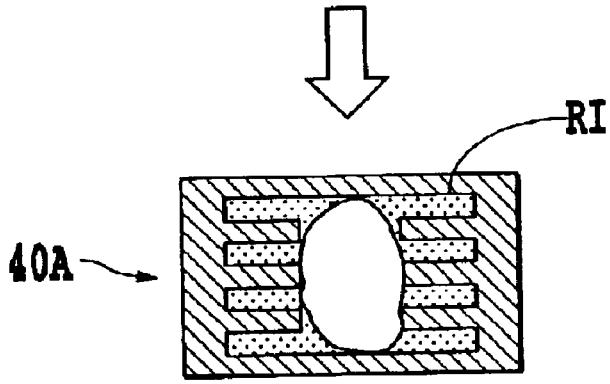
Figure 8C:
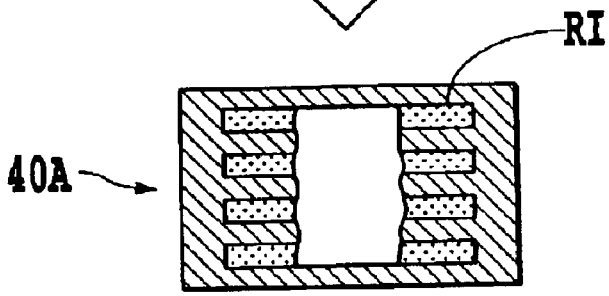

In the sub-tank unit 30A, while the gas is being sucked from each ink storage 35, if the ink is raised up to the vicinity of the interface between the gas liquid separation member 41 and the ink absorbing members 34, the ink may remain in this place. To deal with this problem, the capillary members 40A of the sub-tank unit 30A each have the plurality of narrowed portions 45 as described above. Thus, the remaining ink RI, initially spread across the central portion 44 and narrowed portions 45 as shown in FIG. 8A, is sucked and moved quickly from the central portion 44 into the narrowed portions 45 because of the capillary force as shown in FIGS. 8B and 8C. Then, the ink in the narrowed portions 45 is moved quickly toward the ink absorbing member 34 because the capillary member 40A has a weaker capillary force than the ink absorbing member 34.

In this way, the sub-tank unit (liquid container) 30A also reliably prevents ink from remaining in the vicinity of the gas liquid separation member 41. This makes it possible to maintain the appropriate suction through the gas liquid separation member 41. Consequently, ink can be supplied much more stably and reliably to each liquid storage 35. Further, since each capillary member 40A is interposed between the corresponding ink storage 35 (ink absorbing member 34) and the gas liquid separation member 41, the structure of the liquid storage 35 (the shape of the liquid absorbing members 34) can be simplified and an easy and flexible arrangement of the components of the sub-tank unit 30A can be achieved. Furthermore, in the sub-tank unit 30A, the leakage of the ink or internal gas can be reliably prevent because the gas liquid separation member 41 and the ink absorbing members 34 do not directly interfere with each other.

In the ink jet printing apparatus 1 (ink jet cartridge 20) provided with the sub-tank unit 30A, in order to stabilize the ejection of ink, a constant negative pressure must be generated at the nozzles of the ink jet print head 21. As described above, in general, the capillary force of the ink absorbing member 34 is desirably at least about 500 Pa (about 50 mmAq). In view of this point, the capillary force of the capillary member (porous member) 40A is preferably set to at least 50 Pa (about 5.0 mmAq) and at most 500 Pa, more preferably at least 50 Pa and at most 300 Pa. To accomplish this with the capillary member 40A including the narrowed portions 45, the width of the narrowed portions 45 may be 1 mm or less. If the width of the narrowed portion 45 is larger than 1 mm, the narrowed portions 45 may fail to contribute to generating capillary force.

Figure 8D:
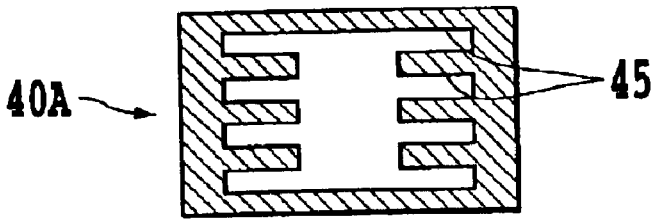

In this embodiment, only the peripheral area of the capillary member 40A defining the central portion 44 and the narrowed portions 45 is in contact with the corresponding ink absorbing member 34 and the gas liquid separation member 41. However, even this structure enables the remaining ink RI to return to the ink absorbing member 34. That is, if the ink has a sufficiently high surface tension, the ink RI in the narrowed portions 45 is joined to the ink RI located in the central portion 44 as shown in FIG. 8B. Consequently, the RI is seamlessly sucked by the ink absorbing member 34 as shown in FIGS. 8C and 8D.

FIGS. 9 to 14 show variations of the capillary member according to the second embodiment. As capillary members 40B to 40G shown in these drawings, the form of the capillary member may be optionally selected depending on the size or shape of the container main body 32, the characteristics of the ink, or the like.

Figure 9:
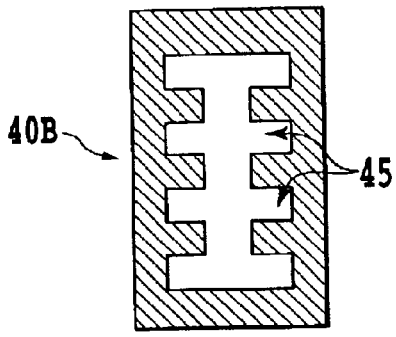
FIG. 9 is a sectional view showing a variation of capillary members according to the second embodiment of the present invention.
Figure 10:
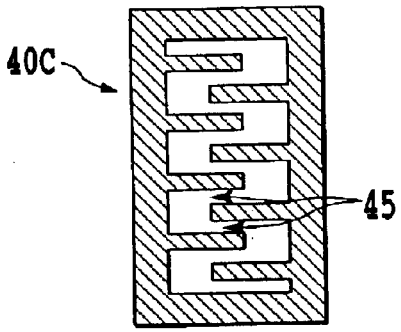
FIG. 10 is a sectional view showing a variation of the capillary members according to the second embodiment of the present invention.
Figure 11:
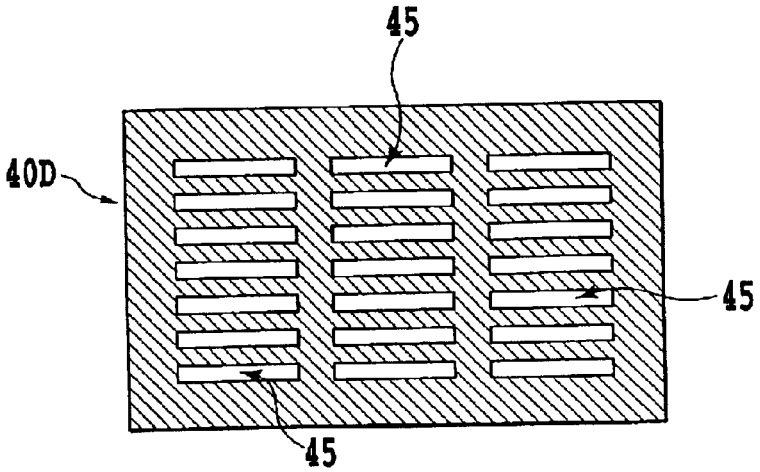
FIG. 11 is a sectional view showing a variation of the capillary members according to the second embodiment of the present invention.
Figure 12:
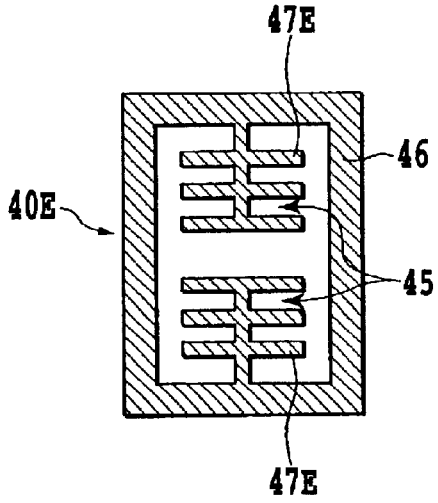
FIG. 12 is a sectional view showing a variation of the capillary members according to the second embodiment of the present invention.
Figure 13:
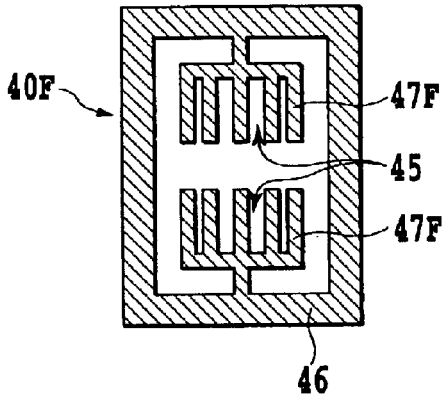
FIG. 13 is a sectional view showing a variation of the capillary members according to the second embodiment of the present invention.
Figure 14:
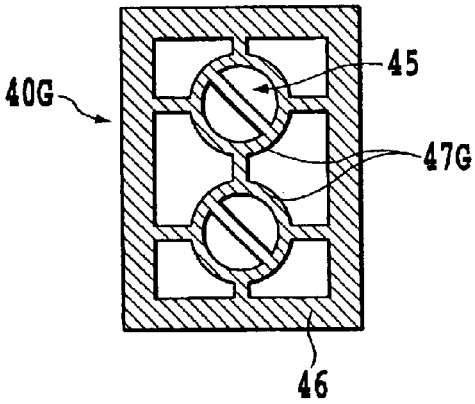
FIG. 14 is a sectional view showing a variation of the capillary members according to the second embodiment of the present invention.

The capillary members 40B and 40C shown in FIGS. 9 and 10 respectively include short narrowed portions 45 which are formed to extend in a direction perpendicular to the longitudinal direction of the cross section of the capillary members 40B and 40C. The capillary member 40D shown in FIG. 11 corresponds to the integration of three capillary members 40A described above. A sub-tank unit using the capillary member 40D requires only one chamber for accommodating the capillary member 40D. The one chamber and the capillary member 40D serve as a plurality of ink storages. The capillary members 40E to 40G shown in FIGS. 12 to 14 respectively include an outer frame portion 46 and comb-like or annular extending portions 47E, 47F or 47G. The extending portions 47E, 47F and 47G are inwardly extended from the outer frame portion 46 and define the narrowed portions 45.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A liquid container capable of containing a predetermined liquid, comprising:

a container main body having a liquid storage for storing said liquid;

a ventilation path enabling said liquid storage and an outside of said container main body to communicate with each other;

a plurality of liquid absorbing members arranged in said container main body so that said liquid can be stored in each of said liquid absorbing members, wherein for each of said liquid absorbing members, there is a corresponding capillary member generating a capillary force; and a single gas liquid separation member disposed between each of said capillary members and said ventilation path.

2. A liquid container according to claim 1, wherein the capillary force of each of said capillary members is weaker than that of said liquid absorbing members.

3. A liquid container according to claim 1, wherein at least part of an end surface of said capillary member on the side of said gas liquid separation member is in contact with said gas liquid separation member.

4. A liquid container according to claim 1, wherein said capillary member has a porous structure.

5. A liquid container according to claim 1, wherein said capillary member has a capillary force of at least 50 Pa and at most 500 Pa.

6. A liquid container according to claim 1, wherein said capillary member includes a hole extending from one end surface to the other end surface thereof.

7. A liquid container according to claim 6, wherein said hole includes a narrowed portion having a width of 1 mm or less.

8. A liquid container according to claim 1, further comprising a communication port allowing said liquid storage to communicate with the outside of said container main body, wherein a pressure in said liquid storage is reduced by sucking a gas from said liquid storage via said ventilation path, said gas liquid separation member and said capillary member, so that said liquid can be supplied into said liquid storage via said communication port.

9. A liquid container according claim 1, wherein said liquid is ink for ink jet printing.

10. An ink jet cartridge comprising:

an ink jet print head capable of ejecting ink for image printing;

an ink container for said ink fixed or detachably connected to said ink jet print head, said ink container including: a container main body having an ink storage for storing said ink; a ventilation path enabling said ink storage and an outside of said container main body to communicate with each other; an ink intake port allowing said ink storage to communicate with the outside of said container main body;

a plurality of ink absorbing members arranged in said container main body so that said ink can be stored in each of said ink absorbing members, wherein for each of said ink absorbing members, there is a corresponding capillary member generating a capillary force; and a single gas liquid separation member disposed between each of said capillary members and said ventilation path.

11. An ink jet printing apparatus comprising an ink jet cartridge according to claim 10, wherein a pressure in said ink storage is reduced by sucking a gas from said ink storage via said ventilation path, said gas liquid separation member and said capillary member, so that said liquid can be supplied into said ink storage via said ink intake port.

12. An ink jet printing apparatus according to claim 10, wherein said ink jet print head of said ink jet cartridge includes an electrothermal converting element for generating thermal energy and ejects ink droplets using thermal energy generated by said electrothermal converting element.

* * * * *

UNITED STATES PATENT AND TRADEMARK OFFICE

CERTIFICATE OF CORRECTION

PATENT NO. : 6,840,610 B2
APPLICATION NO. : 10/370528
DATED : January 11, 2005
INVENTOR(S) : Suguru Taniguchi et al.

Figure 15:
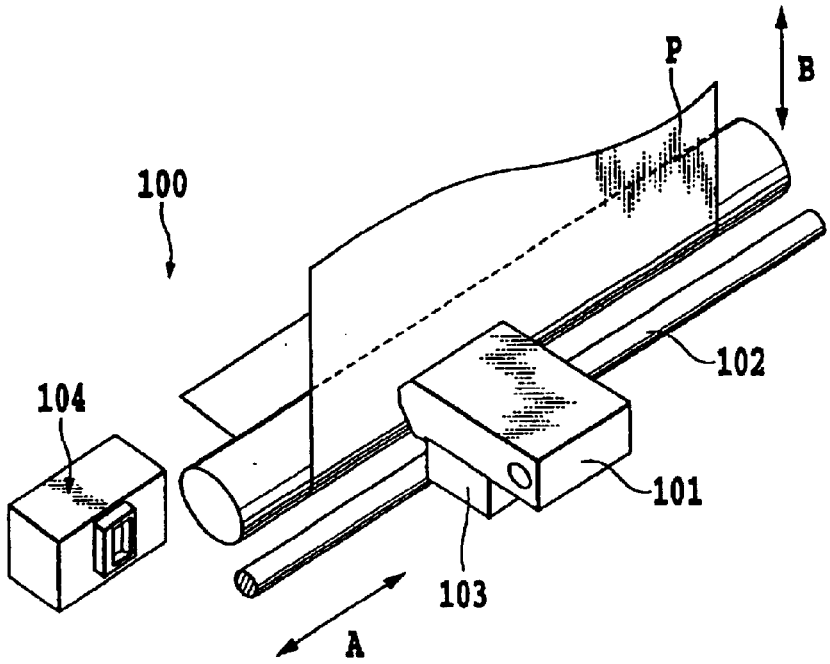
FIG. 15 is a perspective view showing a conventional ink jet printing apparatus.
Figure 16A:
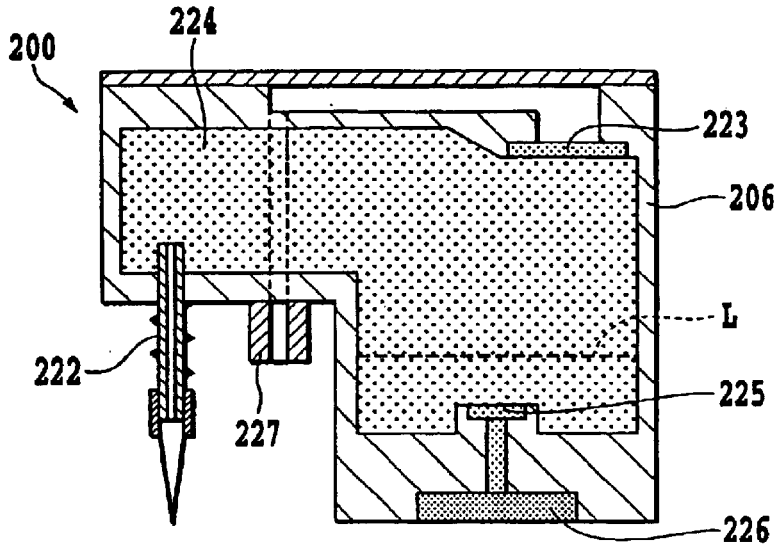
FIG. 16A is a sectional view showing a sub-tank unit of a conventional pit-in-method-based ink jet printing apparatus.
Figure 16B:
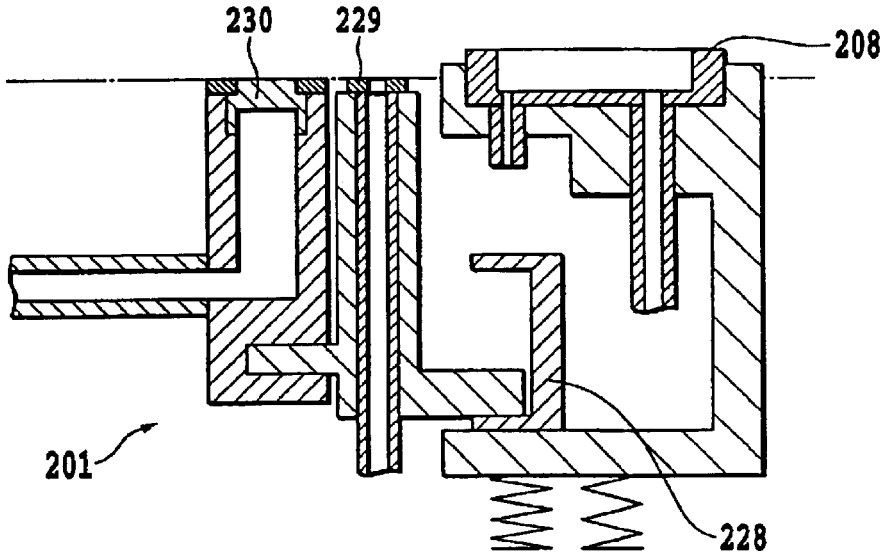
FIG. 16B is a sectional view showing an ink supply recovery unit separated from the sub-tank unit of FIG. 16.
Figure 17:
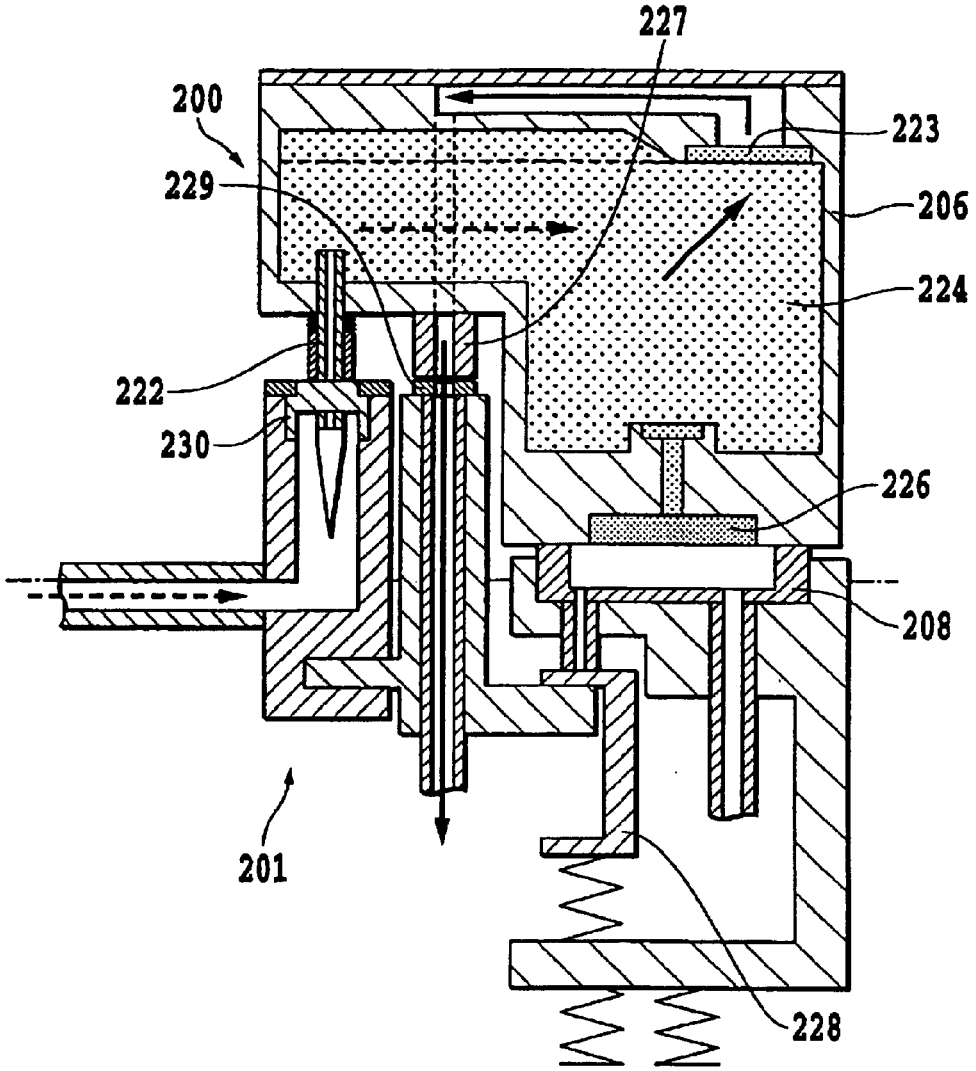
FIG. 17 is a sectional view showing the sub-tank unit and ink supply recovery unit coupled together.

It is certified that error appears in the above-identified patent and that said Letters Patent is hereby corrected as shown below:

IN THE DRAWINGS:

Figure 15 should be labeled --Prior Art--.

COLUMN 14

Line 30, "according" should read --according to--; and
Line 57, "claim 10," should read --claim 11,--.

Signed and Sealed this

Eighteenth Day of September, 2007

JON W. DUDAS
*Director of the United States Patent and Trademark Office*